US006044675A

United States Patent [19]

Davi

[11] Patent Number: 6,044,675

[45] Date of Patent: Apr. 4, 2000

[54] ROLL BENDING MACHINE WITH SELECTIVE DIGITAL CONTROL DEVICE

[75] Inventor: Orazio Maria Davi, Cesena, Italy

[73] Assignee: Promau S.R.L., Cesena, Italy

[21] Appl. No.: 09/200,711

[22] Filed: Nov. 27, 1998

[30] Foreign Application Priority Data

Nov. 27, 1997 [IT] Italy ..... MI97A2637

[51] Int. Cl.[7] ..... B21D 5/14

[52] U.S. Cl. ..... 72/7.1; 72/173

[58] Field of Search ..... 72/173, 174, 166, 72/7.1, 6.2, 6.1

[56] References Cited

U.S. PATENT DOCUMENTS 1,614,425 1/1927 Coe .
4,148,203 4/1979 Farazandeh ..... 72/21
4,321,208 3/1982 Schäfer ..... 72/166
4,491,004 1/1985 Ivanoff ..... 72/168
5,187,959 2/1993 Davi ..... 72/173
5,642,291 6/1997 Prunotto ..... 72/422

*Primary Examiner*—Daniel C. Crane
*Attorney, Agent, or Firm*—Young & Thompson

[57] ABSTRACT

An automatic roll bending machine for bending metal sheets, sections and the like. The machine includes two or more bending rolls and a driver for causing rotation and/or changing the working positions of the rolls. The driver is operatively connected to an electronic control device that includes a programmable process unit provided with a movable digital control board which can be manually operated by an operator for remotely controlling in a selective manner the movements of each roll and for performing automatic execution of a bending cycle.

4 Claims, 4 Drawing Sheets

| | M1 | M2 | M3 |
|---|---|---|---|
| 1 | 1110100111000111 | 0000000000000000 | |
| 2 | | 0000000000000000 | |
| 3 | | | |
| | | | |
| | | | |
| | | | |
| | | | |
| 8 | | 0000000000000010 | |
| | | | |
| | | | |
| 2000 | | | |
| | | 80 | 80 |

ROLL BENDING MACHINE WITH SELECTIVE DIGITAL CONTROL DEVICE

BACKGROUND OF THE INVENTION

The present invention relates to an automatic apparatus for bending metal sheets, sections and the like and more precisely the invention is concerned with a roll bending machine provided with a manually operable control device for remotely controlling, in a selective manner, the movements of the various bending rolls of the machine or for performing automatic execution of a bending cycle.

STATE OF THE ART

As is known, sheet-metal roll bending machines differ according to the different number of working rolls used to support and shape a metal sheet or a section during a bending cycle.

Roll bending machines with two or more rolls therefore exist and are differently used depending on the type of operation to be performed; examples of roll bending machines with several bending rolls may be found for example in U.S. Pat. No. 1,614,425, U.S. Pat. No. 4,491,004, U.S. Pat. No. 4,312,208 and U.S. Pat. No. 5,187,959, to which reference should be made for a fuller understanding of the general features of a bending machine of this type.

Roll bending machines are generally provided with an electric control panel, comprising levers, pushbuttons, detectors, alarms and all those devices which allow manual and automatic control or positioning of the various moving parts of the bending machine.

In conventional bending machines, depending on the requirements of the user and or the features of the design, the electric control panel is differently positioned on the frame of the machine, for example at the rear of the same machine, near the housing for the motors and the hydraulic power source which supplies a pressurized fluid to hydraulic cylinders of said bending machine, or/on the front side from where the bent parts are removed, or on a separate console which is operatively connected to the control devices of the bending machine by means of a heavy electrical cable necessary for transmitting all the commands.

The various systems indicated above all have the serious drawback that they considerably restrict the mobility of an operator, especially in the case of large-size machines, often obliging the same operator to leave the control position in order to move closer to the workpiece to check the working condition and the dimensions thereof, thus interrupting the working operation of the machine.

In particular, the arrangement of an electric control panel at the rear of the machine has the disadvantage that it greatly restricts the visual field of the operator who finds himself in the most awkward position for monitoring the working operations which he himself is performing, namely behind the workpiece and in a position where the view of the metal sheets or piece to be worked is greatly hampered by the structure of the bending machine.

The second solution, which envisages the arrangement of the control panel on a console protruding from the front side of the machine, is generally more convenient since it allows a visibility which in certain respects is better than the previous solution, however it nevertheless obliges the operator to remain in a fixed or only partially mobile position, restricting his movements and manoeuvres, i.e. limiting his freedom of operation especially during the step involving removal of the finished piece from the machine, since he is standing exactly along the path where the piece is to be withdrawl.

The third solution in which the control panel is provided on a console which is movably mounted on wheels is more versatile since it allows the operator to displace the console on both sides of the machine, into a position which he considers most convenient or suitable for controlling the working operations in progress.

This latter solution has the disadvantage, however, that it requires electric consoles or panels which are extremely heavy and awkward to drag or move in the required direction and is again vulnerable owing to the presence of the large connecting cable which, sliding along the ground, risks being crushed or irreparably damaged should a moving vehicle pass over the cable itself.

Moreover, the displacement of the wheeled console, in particular in working environments where there are floors which are not perfectly level, or with metal sheets on the ground, results in vibrations and shocks which at the same time may create problems for the electric equipment of the console. Moreover, it requires for a large amount of space when the machine is not in use.

OBJECTS OF THE INVENTION

The general object of the present invention is to overcome the above mentioned drawbacks, i.e. to provide an automatic apparatus or machine for roll bending metal sheets, sections and the like, which is provided with a control device which has a very small weight and size, allowing the operator to freely move on the sides of the bending machine and by means of which the same operator is able to program the bending machine, or is able to automatically or manually and selectively control all the working movements of the entire machine.

A further object of the invention is to provide an automatic machine for roll bending metal sheets, as defined above, in which the use of a digital control device allows programming and storage of several work cycles which the operator is able to call up, check, modify and perform automatically at any time.

Yet another object of the present invention is to provide an automatic roll bending machine of the kind mentioned above, provided with a manually operable control device of a small-size and low-weight, which can be held in the operator's hands in order to remotely control the machine, the working axes, loading and unloading of the metal sheets.

BRIEF DESCRIPTION OF THE INVENTION

According to a first aspect of the invention, an automatic bending apparatus for roll bending metal sheets has been provided, said apparatus comprising:

a support frame;

at least an upper and lower superimposed bending rolls axially extending in a rotatable manner on the above mentioned support frame, one of the said bending rolls being vertically movable and positionable with respect to the other bending roll;

drive means for moving said rolls and an electronic control device, operatively connected to said drive means, characterized in that said control device comprises a programmable process unit and a movable digital control board manually operable by an operator for programming said process unit and performing command functions of the bending rolls, said control board comprising at least a first and a second monostable keys designed to send opposite single-bit control signals to the process unit in order to selectively control in two opposite directions each of said roll drive means.

According to another aspect of the present invention, the digital control board is provided in a removable manner on the control device, while remaining operatively connected to the process unit of the same electronic control device, in order to perform remote manual operation of the bending machine.

Therefore, according to the present invention, by means of a small control board for controlling the main functions of the bending machine an operator is able to intervene rapidly during any critical step of the working cycle in order to check the position and the movements of the several bending rolls for shaping and/or supporting the metal sheet, or in order to display the various operating parameters; the operating board has very small dimensions and weight and may thus be easily held in the hand, allowing the operator to move with greater ease and freedom around the machine in order to reach the effectively most convenient position which allow him better visibility and highly reliable operation and control of all the working steps.

By means of a particular software configuration and a PLC with specific characteristics, as explained further below, a way has been found to achieve communication between the PLC and the control panel at a nonstandard speed of transmission, equal to or greater than 19,000 bauds compared to the 9,600 bauds which is standard for the range of apparatus used in one of their usual applications.

In this way great advantages are achieved in terms of practical and ergonomic design, safety, working speed and productivity.

BRIEF DESCRIPTION OF THE DRAWINGS

These and further features of the roll bending machine according to the invention, will be described hereinbelow with reference to the accompanying drawings and to a four roll bending machine, without thereby being limiting in respect of applications to other types of sheet-metal bending machines.

In the drawings.

DETAILED DESCRIPTION OF THE INVENTION

Figures 1, 7:
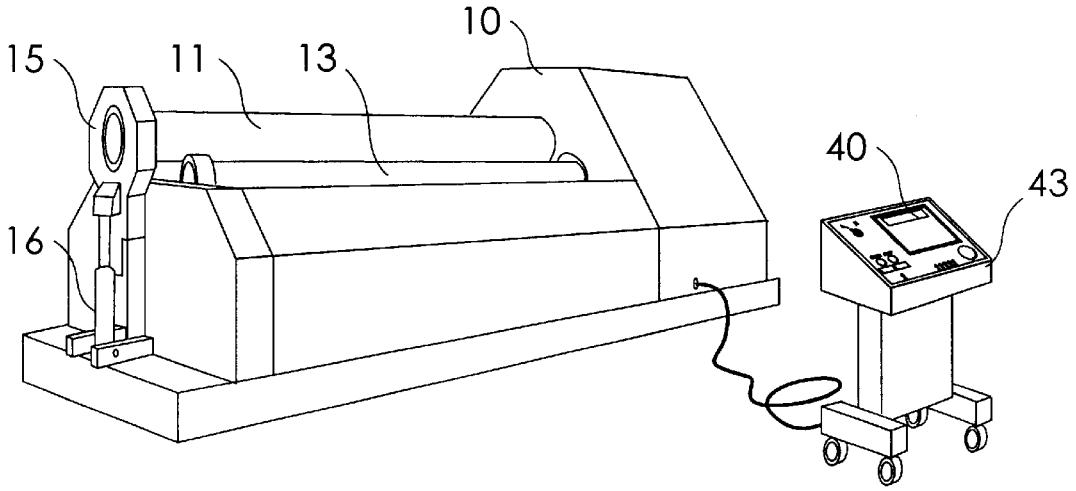
FIG. 1 is a perspective view of a sheet-metal bending machine according to the invention.
FIG. 7 is a representation of the data memory of the control unit, aimed to illustrate the operation mode of the control device for a roll bending machine according to the invention.
Figure 2:
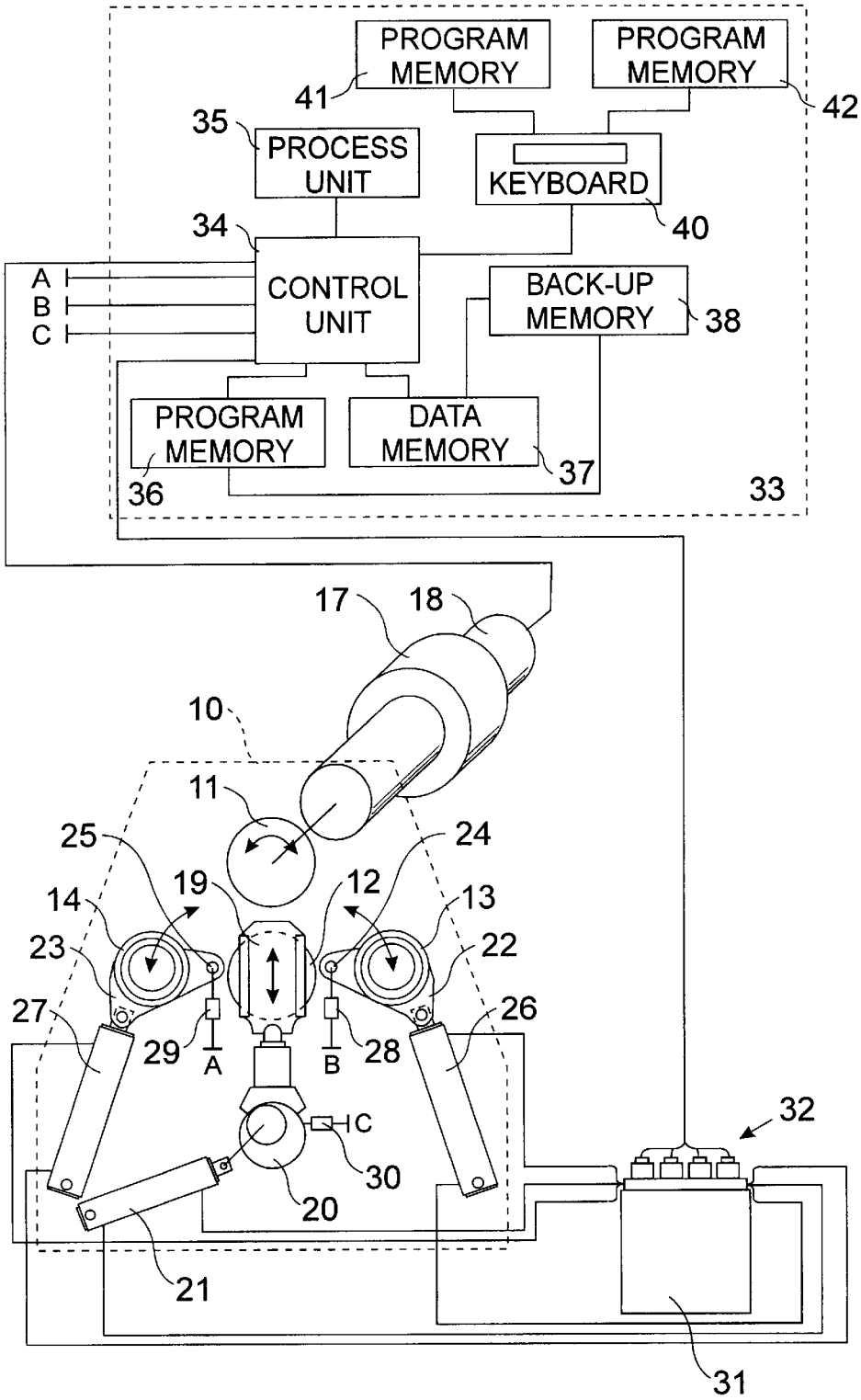
FIG. 2 is a functional diagram of the bending machine according to FIG. 1 and the electronic control device according to the invention.

With reference to FIG. 1 and 2, the general features of a sheet-metal bending machine of the four-roll type and the electronic control device according to the invention will first be described.

As shown, a sheet-metal roll bending machine of the four-roll type in general comprises a frame 10 for supporting an upper bending roll 11, superimposed to a lower bending roll 12, and two side rolls 13, 14 for supporting the metal sheet, which extend parallel to the bending rolls 11 and 12 in the longitudinal direction of the machine.

The upper roll 11 is rotatably supported by suitable end supports, the support 15 of which, at the front end of the machine may be swung or tilted forwards about a horizontal pivot axis by a hydraulic cylinder 16 so as to allow front removal of a finished piece.

The upper roll 11 is made to rotate in both directions by a motor drive 17 provided with an encoder or signal generator 18 suitable for supplying at each time control signals related to the speed and angular rotation of the roll itself.

Differently, the lower bending roll 12 is rotatably supported so as be moved vertically upwards and downwards with respect to the upper roll 11, by leans of two support slides 19, only one of which is shown in FIG. 2 and which slide along lateral guides.

Each slide 19 is moved upwards and downwards by means of a cam system 20 which is actuated by a hydraulic cylinder 21.

Similarly, each of the two side rolls 13 and 14, in the example shown, is supported so as to rotate idly by means of a pair of tiltable end supports 22 and 23 which allow controlled displacement of the said rolls along an arched path or inclined towards the two central rolls 11 and 12. In the example according to FIG. 2, each end support 22, 23 is pivotably hinged at 24 and 25 to the frame 10 of the machine and is connected to a respective hydraulic actuator or cylinder 26, 27.

In a manner similar to rotational operation of the upper bending roll 11, the displacements of the lower bending roll 12 and the side rolls 13 and 14 are controlled by means of respective encoders or signal generators 28, 29 and 30 which are connected, respectively, to the axes 24, 25 of the pivotable end supports 24 and 25, in the case of the side rolls, and to the axis 20, in the case of the lower roll 12.

Finally, in FIG. 2, reference 31 denotes a hydraulic power source for supplying pressurized fluid to the various hydraulic cylinders by means of a set of solenoid valves 32 which may be manually or automatically actuated in a programmed manner by means of an electronic control device denoted in its entirety by reference 33.

Figure 3:
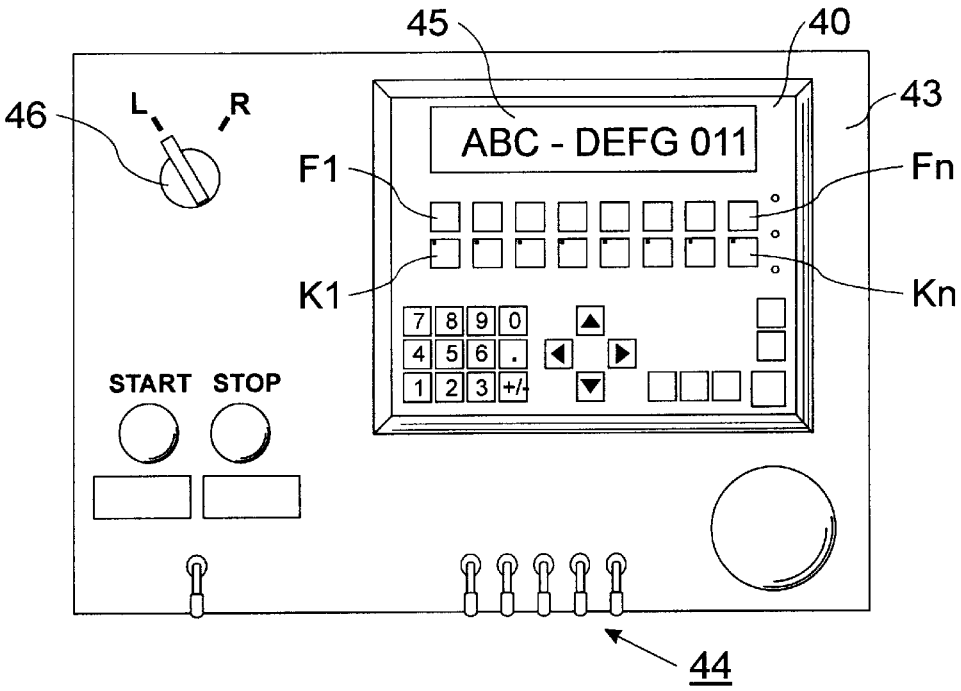
FIG. 3 is a schematic illustration of the control board.

As shown in FIGS. 2 and 3, the electronic control device 33 comprises a programmable control unit 34 for managing the work program of the bending machine, consisting for example of a PLC with its own process unit 35, such as a CPU, and also comprises a first program memory 36, a second data memory 37, as well as third back-up memory 38 of the permanent type. The PLC 34 is also connected, by an interface not shown, to the set of solenoid valves 32 of the hydraulic power source 31 and is also connected to the various signal generators or encoders 18, 28, 29 and 30 which control the positions and/or movements of the various rolls or movable parts of the bending machine.

The electronic control device 33 comprises, moreover an operative board 40 of the digital type, which can be manually operated by an operator so as to perform a series of functions for programming and operation of the bending machine, as well as display of the various functions and the various states of the working cycle for the individual roll actuating axes.

The operative board 40 which constitutes a connection interface between the bending machine and the operator, is of the digital type and comprises a first program memory 41 and a second memory 42 for storing the work programs of the bending machine, which may be transferred from time to time to the PLC so as to be automatically performed in the manner described below.

The operative board 40 may be of any suitable type, provided that its functional characteristics are compatible with the PLC 34; the board 40 may be located anywhere, both on a console fixed to the frame of the machine or on a wheel-mounted console 43 comprising all the electronic control equipment 33.

The operating board 40, as will be illustrated further below, according to a first aspect of the present invention, may be used by an operator both in order to formulate and store the work programs of the bending machine, transferring then from time to time to the PLC for execution thereof; the operative board 40 is also used for checking the operative statuses of the entire machine in addition to selectively controlling each of the abovementioned working axes, for example the degree of rotation of the upper roller 11, as well as for controlling the position of the two side rolls 13, 14 in a four-roll bending machine.

All this may be obtained by suitably setting the operative mode of the said board 40, selecting a working axis by using one of the various function keys, and acting in one direction or the other by means of two monostable pushbuttons, as will be explained below.

The operative board 40 may be supported in a fixed manner by the console 43, allowing the operator nevertheless to check all of the functions of the bending machine in an extremely simple and rapid manner.

However, according to another aspect of the present invention, the operative board 40 may be provided in a removable manner such that it can be withdrawn from the console 41, while remaining operatively connected to the PLC 34. This may be achieved, for example by means of a small connection cable of the desired length, via radio or in another suitable manner so as to form a kind of remote control system which is movable and can be managed in different ways by the operator; thus the operator, standing in any position with respect to the bending machine, is able to perform execution of an automatic cycle or a manual cycle by simply pressing pushbuttons to supply single-bit control signals to the PLC for the whole of the period during which the pushbuttons remain depressed; therefore, the single-bit signals will be immediately transmitted to and processed by the PLC 34 so as to execute or control in real time the various movements of the bending machine, in two opposite directions, under the direct visual control of the operator.

The control console 43 and the operative board 40 are illustrated in more detail in FIG. 3. As can be seen from this figure, the console 43 comprises two sets of manual controls: more precisely, it comprises a first sets of manual controls consisting of a group of levers 44 which activate in an entirely conventional manner the movement of the various rolls, a START pushbutton for starting the machine, and a STOP pushbutton for stopping operation of the bending machine in automatic mode, and also comprises the operative board 40 mentioned above. A switch 46 enables to select between manual operation of the levers 44 in the position L, deactivating the manual controls of the operative board 40, and the manual controls of the operative board in the position R, deactivating the control levers 44 for safety reasons.

In turn the operative board 40, in the example shown, comprises a display 45, a first set of functional keys F1–Fn of bistable type, as well as a second set of functional keys K1–Kn of monostable type, in addition to a set of system keys, for example of the numerical or other type, in a manner known per se.

Operation of the the apparatus will be illustrated hereinbelow with reference to the remaining figures.

First of all it is necessary to program the system by means of the operative board 40 so that the various hardware outputs of the PLC are selectively activated, manually operates the specific keys of the board 40, or the various outputs are activated automatically in sequence depending on the selected working program.

It is also necessary to establish all the conditions which must be present so that each hardware output of the PLC is activated both during manual and automatic operation of the bending machine.

As known, the data memory of a PLC may be schematically represented by the three tables M1, M2 and M3 of FIG. 7, relating to the "words" memory the "marker" memory and the "special marker" memory, each of which consists of a plurality of binary memory cells capable of recording, with their physical state, a binary digit "one" or "zero" depending on whether a pulse is present or not in the information signal (bit); each cell is in turn distinguished by a numerical address indicating the memory zone or segment in which the said cell is located and by the associated output of the PLC.

According to the present invention one of the data memories of the PLC, in particular the "marker" memory M2, is used for the command activating the various outputs of the PLC, using a single address pulse bit corresponding to the selected axis at the prechosen output, which is kept at the status "one" for the whole of the time during which a specific pushbutton K of the operative keyboard 40 is kept pressed.

Taking for example an X axis of the machine, associated with a side roll, so that the respective output may be activated for positive or negative operation of the axis, depending on whether the side roll 13 must be raised or lowered, moving it towards or away from the upper roll 11, it is necessary to program suitably, i.e. to set to "one" the memory M2 at the concerned address, for example at the memory address 8.1 in FIG. 7, for positive operation in one direction, or the memory address 8.1 for negative operation in the opposite direction by pressing, during programming, the pushbutton K1 or the pushbutton Kn of the digital control panel 40.

Figure 4:
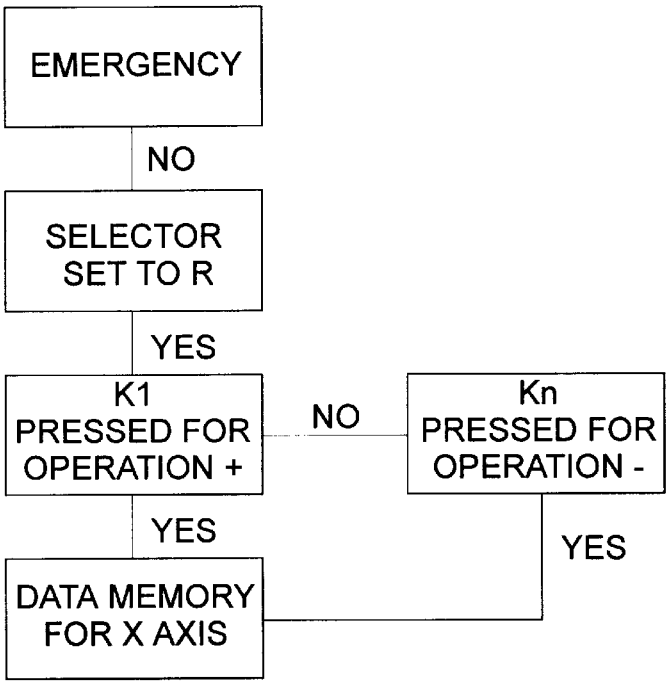
FIG. 4 is a first flow diagram for selective operation of the various axes of the machine.

As already mentioned, however, certain conditions must be present, as schematically shown, for example, in the flow diagram of FIG. 4; in particular, the apparatus must not be in the emergency condition and the selector 46 must be in the remote control condition R. With these conditions, by pressing the pushbutton K1 on the board 40, the program will proceed to set to one the corresponding inlet of the PLC. In order for this condition to occur, the pushbutton Kn relating to the negative operation function must also not be depressed. Vice versa, for negative operation of the X axis, the pushbutton Kn must be pressed and it must be checked that K1 is in turn not depressed.

Figure 5:
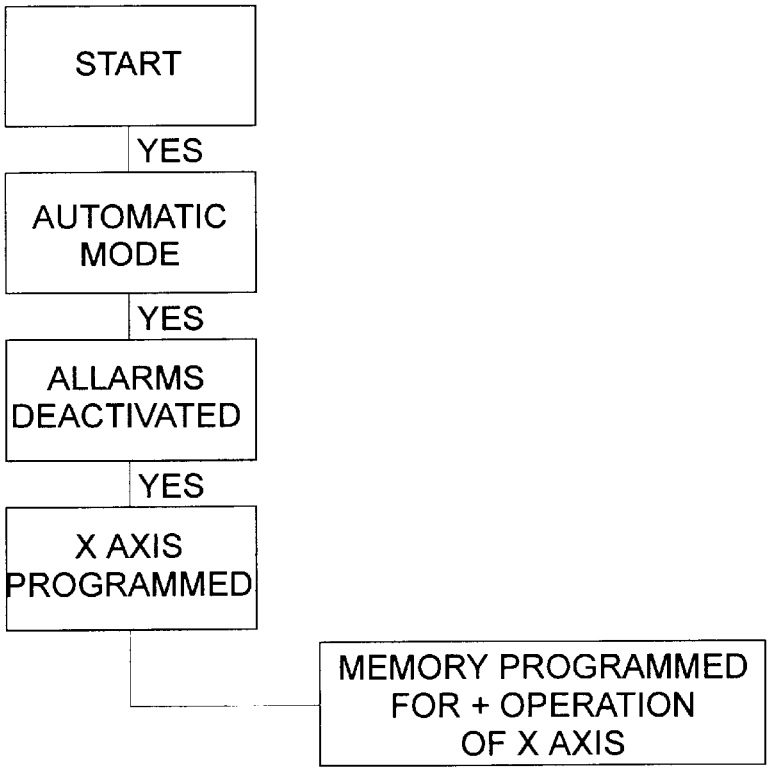
FIG. 5 is a flow diagram for automatic operation of a programmed axis.

Similarly, in the case of automatic execution of the working cycle, it is necessary to program the individual axes of the machine; this is illustrated by way of example for the axis X in the flow diagram according to FIG. 5. As shown, the START pushbutton must be initially pressed and, using the function keys of the board 40, the mode for operation in automatic must have been selected, the alarms deactivated and programmed axis selected in each case so as to set the corresponding inlet of the PLC to the value "one".

Once the various memories have been programmed, both for operation both in automatic and in manual mode, it possible to activate operation of the machine, with immediate response times, operating the PLC on the basis of the principle of direct assignment of the outlet.

Figure 6:
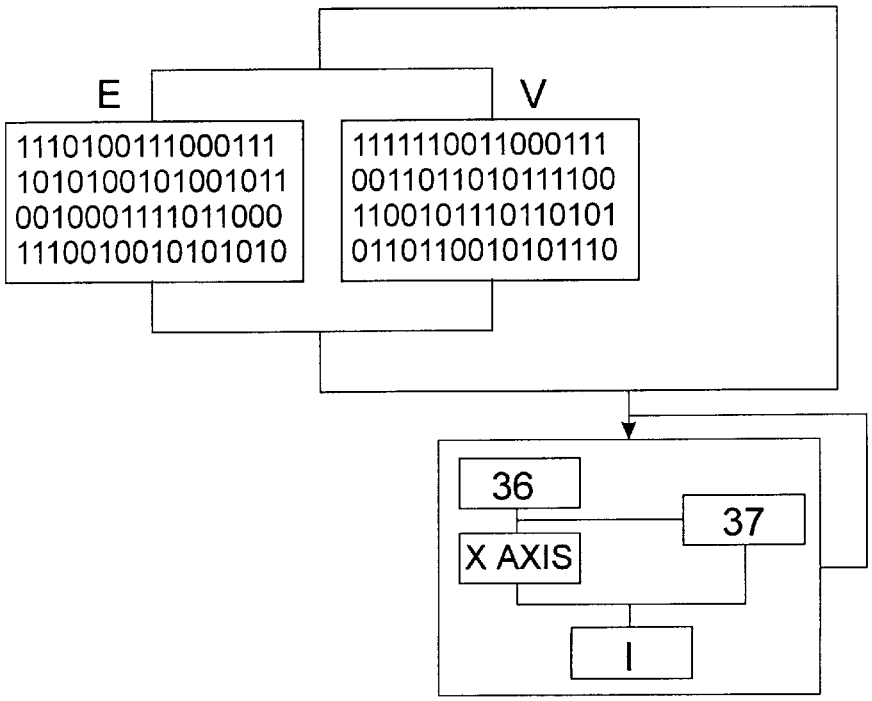
FIG. 6 is a diagram illustrating the operating mode of the PLC of the process unit, with direct assignment of an output during control or a programmed axis.

This may be more fully clarified with reference to the diagram of FIG. 6 which shows the operative mode of the PLC. In this figure, E indicates the table of the various inlets, while U denotes the table of the various outlets which are cyclically read, updating in each case each outlet U depending on the status of the corresponding inlet E. However, this cyclical operating mode of the PLC during reading of the inlets and outlets would result in excessively long response times which would not allow any positive control of the various axes of the bending machine.

In order to obtain immediate response times, during operation in manual mode, by means of use of a digital control board according to the present invention, as already explained above, operation is performed in two ways, namely using special monostable pushbuttons, not linked to the program pages, in order to activate the various inlets of the PLC by means of a single-bit signal, keeping it active for the whole of the time needed to bring each individual axis into the desired position, as well as by means of direct assignment of the outlets of the said PLC so as to activate the various solenoid valves supplying the oil under pressure for the cylinders actuating the axes or so as to activate the motor 17 or operation of the upper roll 11.

In this connection, operation is not performed directly with activation of the specific outlet by the PLC, since operating in this manner would introduce a corresponding delay into the cycle or into the portion of the operating cycle of the PLC for circulation of the flow of instructions. According to the present invention, as shown in FIG. 6, the two operative conditions in automatic mode and manual mode are grouped together and the PLC program is formulated such that, depending on the working cycle selected with the respective memory 36 or 37, at a certain point the command I for direct assignment of the PLC outlet is activated, setting a specific hardware outlet, independently of the point reached by the cycle of the PLC.

From what has been said and illustrated in the accompanying drawings, it will be obvious that an automatic apparatus for bending metal sheets has been provided, said apparatus using in an original and novel manner, a digital control device for operation, in automatic mode or selectively, of the various axes of the machine by an operator who, displacing the console or removing and holding in his hands the said digital control board, is able to assume the most suitable position or condition for observing the machine and the workplace. It is understood, however, that what has been said and illustrated, with reference to a four-roll machine, may also be applied to any other type of bending machine for metal sheets or sections and that other modifications or variations may be made to the said apparatus and to the operating programs without thereby departing from the principles of the present invention.

What I claim is:

1. Automatic apparatus for roll bending metal sheets and/or sections, comprising:

a support frame;

at least an upper bending roll and a lower bending roll axially extending and rotatably supported by the support frame, one of the said bending rolls being movably supported in a vertical direction to be positioned with respect to the other bending roll;

drive means for moving the rolls and an electronic control device operatively connected to said drive means, said control device comprising a programmable process unit and a digital control board manually operable by an operator for programming said process unit and performing command functions, said control board comprising at least a first and a second monostable keys designed to send different types of single-bit signals to the process unit in order to selectively control in two opposite directions each of said roll drive means, said digital control board being removable from said control device while remaining operatively connected to the process unit.

2. Apparatus according to claim 1, wherein the control board is operatively connected to the process unit through one of a cable and a radio system.

3. Apparatus according to claim 1, in which said process unit is programmable, by means of the digital control unit, for execution of an automatic working cycle or for selective operation in a manual mode of the various axes of a bending machine, and said process unit comprises memory mean program for activation of the various inlets of the process unit by a pulse bit emitted by a pushbutton on the control board or automatically by the process unit, as well as by means of direct assignment of an outlet during the working cycle of the process unit.

4. Apparatus according to claim 1, wherein the control board comprises a program memory and additional memory for storing different automatic programs, for controlling the various working axes of said apparatus.

* * * * *